US009162522B1

(12) United States Patent
Sooklaris

(10) Patent No.: US 9,162,522 B1
(45) Date of Patent: Oct. 20, 2015

(54) KEYABLE BRACES FOR CANVAS STRETCHER FRAMES

(71) Applicant: John Sooklaris, Coronado, CA (US)

(72) Inventor: John Sooklaris, Coronado, CA (US)

( * ) Notice: Subject to any disclaimer, the term of this patent is extended or adjusted under 35 U.S.C. 154(b) by 0 days.

(21) Appl. No.: 14/080,594

(22) Filed: Nov. 14, 2013

Related U.S. Application Data

(60) Provisional application No. 61/726,469, filed on Nov. 14, 2012.

(51) Int. Cl.
*B44D 3/18* (2006.01)

(52) U.S. Cl.
CPC ..... *B44D 3/185* (2013.01)

(58) Field of Classification Search
USPC ..... 160/374.1, 379, 374; 38/102.3, 102.4, 38/102.5
IPC ..... B44D 3/185
See application file for complete search history.

(56) References Cited

U.S. PATENT DOCUMENTS

| | | | | | |
|---|---|---|---|---|---|
| 192,319 | A | * | 6/1877 | Witt | 160/374.1 |
| 251,253 | A | * | 12/1881 | Lazerges | 160/374.1 |
| 1,847,925 | A | * | 3/1932 | Carter | 160/374.1 |
| 3,012,362 | A | * | 12/1961 | Blinderman | 160/374.1 |
| 3,651,854 | A | * | 3/1972 | Terna | 160/374.1 |
| 3,882,616 | A | * | 5/1975 | Starzyk | 38/102.1 |
| 6,520,240 | B2 | | 2/2003 | Sooklaris | |

* cited by examiner

*Primary Examiner* — David Purol
(74) *Attorney, Agent, or Firm* — Thomas M. Freiburger

(57) ABSTRACT

A keyable brace system for stretched canvases provides for keying-out the stretcher bars of a stretcher frame when needed, using interchangeable brace components that can be used face-up or face-down. The braces are of low profile, suitable even for stretcher frames of nominal ¾ inch depth, about ½ inch at inner side of the stretcher bar. Instead of relying on a tongue at the end of each brace to extend into a groove in the side of the frame's stretcher bar, the brace end and the side of the stretcher bar are both grooved and a tapered key is relied on to engage with both the brace and bar grooves to hold the brace in place.

9 Claims, 8 Drawing Sheets

KEYABLE BRACES FOR CANVAS STRETCHER FRAMES

This application claims benefit of provisional application 61/726,469, filed Nov. 14, 2012.

BACKGROUND OF THE INVENTION

The invention concerns artist's canvases, and particularly stretching frames and bracing systems for bracing the stretcher bars in medium and relatively large size canvas frames, to prevent pulling inward of the stretcher bars due to tension resulting from having stretched and tensioned the canvas.

The invention is concerned with generally the same subject matter as U.S. Pat. No. 6,520,240. The patent discloses a bracing system for large canvases, including those requiring more than two cross braces. As explained in the patent, braces have typically been used in a crossing configuration, with a pair of brace bars orthogonally arranged relative to the peripheral stretcher bars. Usually these bars were crossed over one another with routed out sections of each brace, such that the two crossing braces would notch together and lie in the same plane. Where the ends of the braces met the stretcher bars, typically each brace included a protruding tongue or tenon at its end, received in a routed out groove or mortise in the inside surface of the stretcher bar at that location. This would maintain the braces in place. In addition, and as shown in the patent, the ends of the braces could have a groove adjacent to the protruding tenon, allowing a tapered key or wedge to be inserted into the groove with enough force applied to spread the stretcher bar outward relative to the brace-end when needed, such as when the corners of the canvas frame have been keyed out to retighten the canvas.

FIGS. 1 and 2 show a conventional prior art brace system. As seen in FIG. 1, the upper and lower braces 10 and 12 are different, in that the joining notches 14 and 16 are at the bottom and the top, respectively, of these braces. These braces include a tongue or tenon 18 at each end, for extending into a corresponding groove or recess 17 in the side of a stretcher bar 19, to maintain each brace in proper position. A key or wedge could then be inserted into a notch 20 adjacent to the tongue at the end of each brace. This allowed the brace to be supported by the key and to push out or separate the brace-end from the stretcher bar as needed, by use of the key, while the tongue 18 remained in the groove of the stretcher bar. FIG. 2 shows the two cross braces assembled. The braces of U.S. Pat. No. 6,520,240 used this same basic principle.

There are problems with such a brace system in several important applications. Wood is traditionally used in the brace material, as well as for stretcher bars of the frame. It is a practical impossibility to construct braces for ¾ inch deep canvas frames, which are most of the frames sold in the marketplace, many being large frames that tend to require bracing. For ¾ inch frames the braces and wood components would have to be so small that the end features would be thin and susceptible to breakage. The braces must be thinner than the depth of the canvas frames, since they are spaced back from the back of the canvas.

Another problem is that illustrated in FIGS. 1 and 2 and discussed above. These drawings include examples of dimensions, but dimensions will vary. To provide a bracing system for use by consumers, two braces of different configurations would have to be provided such as shown in FIG. 1 (notch at top, notch at bottom), making this impractical for the retailer, who would have to carry two different braces for each length of stretcher bar, therefore doubling the required inventory.

It is a primary object of the invention to simplify bracing of canvas frames with the provision of only one style of brace for each length, and to provide bracing that can be used with ¾ inch depth stretcher frames, as well as frames of other depths.

SUMMARY OF THE INVENTION

The invention achieves this goal with a bracing system in which the braces do not extend into grooves of the frame's stretcher bars but instead are held in place by the same keys or wedges that are used to spread the stretcher bars outwardly from center when needed. A groove in the inside surface of the stretcher bar and a facing groove at the end of the brace allow for a key to be inserted into the groove space defined between brace and stretcher bar, to retain the brace in proper position along the side of the stretcher bar. The groove in the brace end preferably is sloped to match the slope of the wedge or key, for stability and so that when the stretcher bars need to be spread the key is simply forced more deeply into the groove space. Therefore at the ends of the braces it is the key that retains the brace in a fixed position, not relying on a tongue or tenon extending into a stretcher groove for that purpose. At the same time, the key is available to add tension to the canvas, by inserting it even more deeply into the groove space.

The braces of this design can be of thinner profile than the prior braces and can be used for stretcher frames of ¾ inch depth.

These and other objects, advantages and features of the invention will be apparent from the following description of a preferred embodiment, considered along with the accompanying drawings.

DESCRIPTION OF PREFERRED EMBODIMENTS

Figure 3:
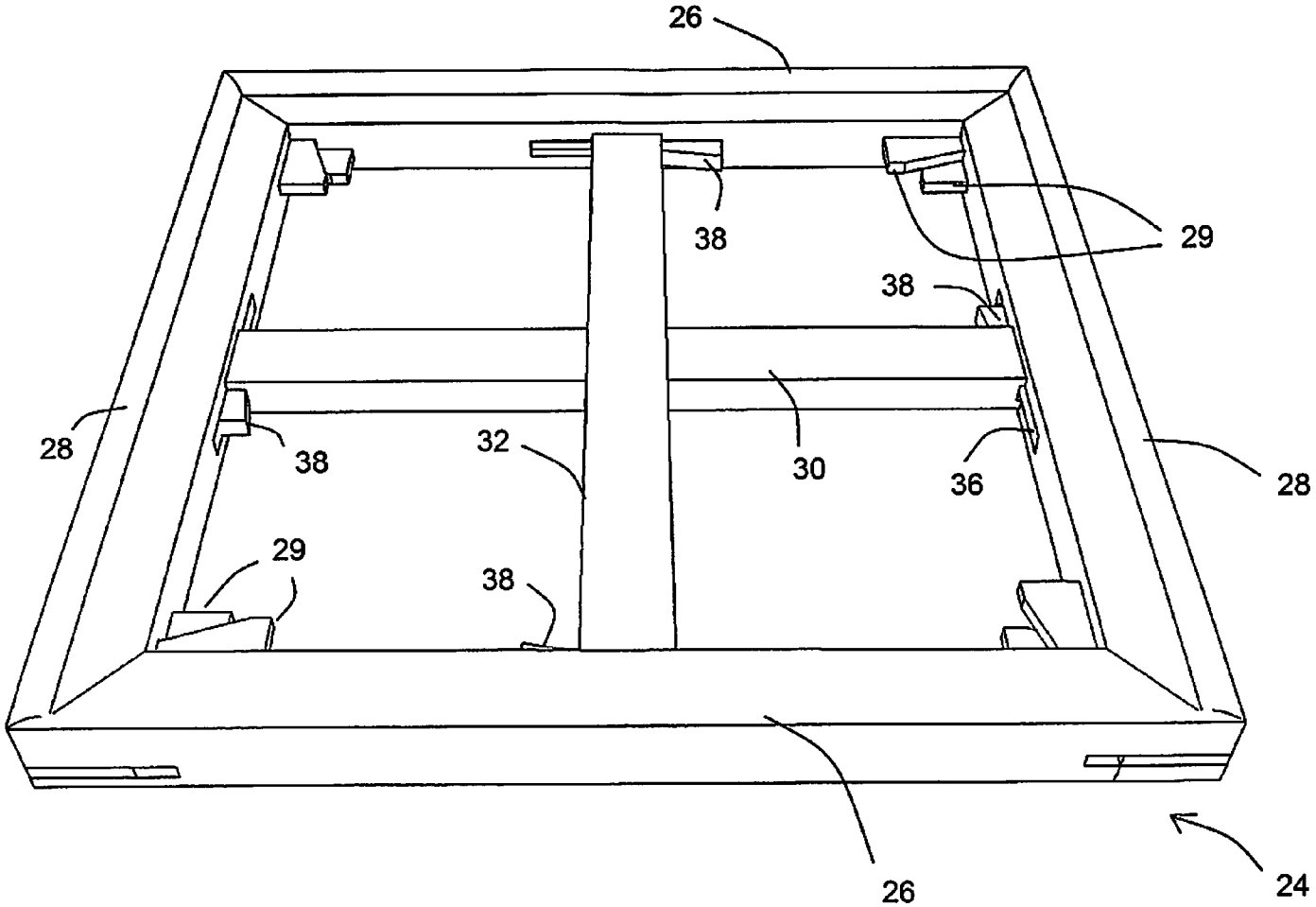
FIG. 3 is a perspective view showing a canvas stretcher frame without canvas, and illustrating the bracing system of the invention.

FIG. 3 shows a canvas stretcher frame 24, formed of side and end stretcher bars 26 and 28, respectively. The corner assembly on this stretcher frame is preferably keyable to expand the frame when needed to increase tension in the canvas, as shown by the corner keys or wedges 29.

FIG. 3 shows two braces in crossing configuration, a vertical brace 30 and a horizontal brace 32. The braces cross at an intersection 34 and overlap via notches, not seen in FIG. 3 but similar to those notches 14 and 16 shown in FIG. 1. However, the braces 30 and 32, assuming they are the same length, are interchangeable. That is, each brace can be used either notch-up or notch-down. All braces of a given length can be identical, reducing a retailer's required brace inventories by half, when the stretcher bars and braces are sold as individual components.

FIGS. 3 through 8 illustrate details of the bracing system of the invention. In FIG. 3 each of the braces is retained in place at a groove or recess 36 in the side of a stretcher bar (26 or 28), at each end of the brace. A wedge or key 38 is provided at each brace-stretcher bar juncture, as illustrated. These keys are similar to others used in the prior art. Here, they not only are available to put outward pressure on the stretcher bars when needed (for canvas tension), but they also firmly retain the braces in place, without need for tenons extending at ends of braces. The keys 38 are typically of wood, but could be other materials such as plastics, metal or composites. The braces could be other materials as well, although wood is typical and preferred.

Figure 4:
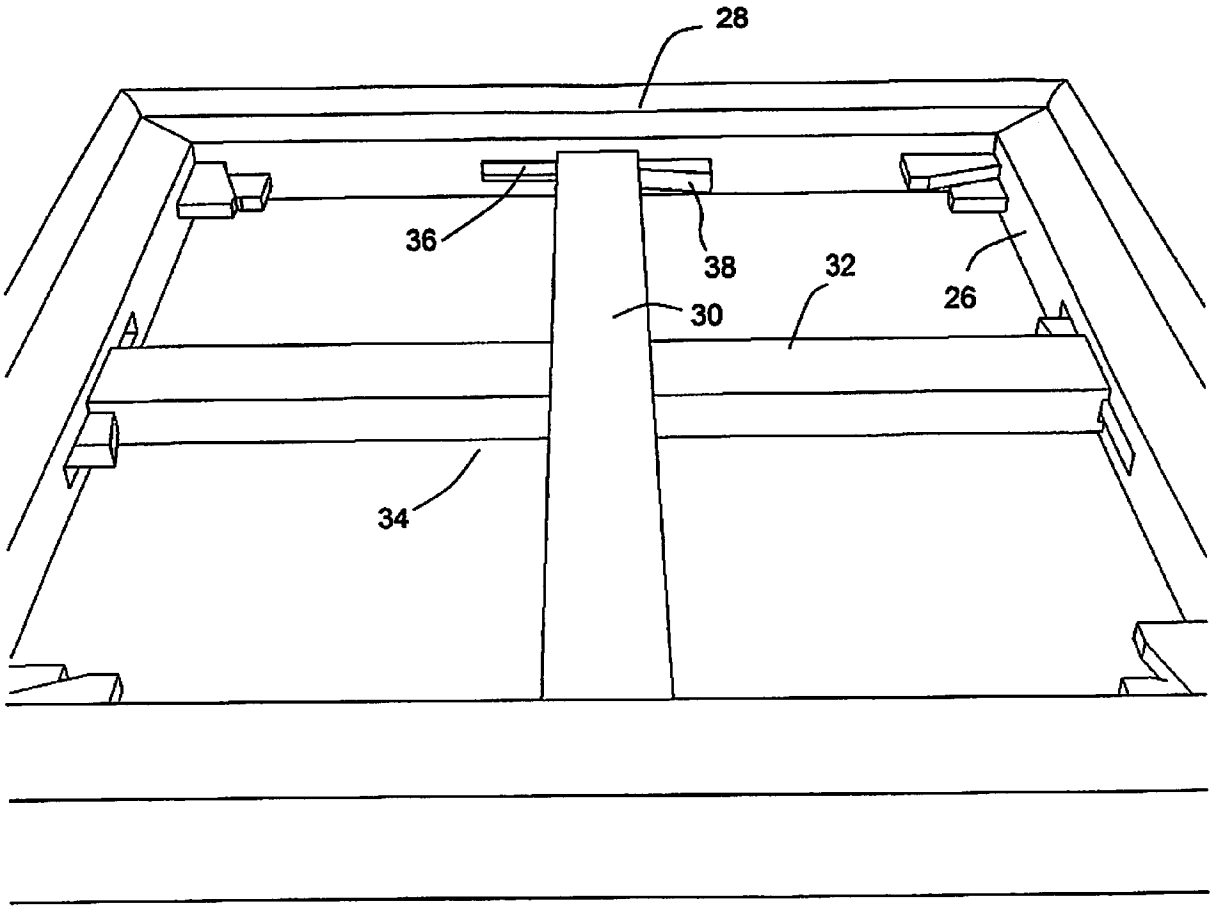
FIG. 4 is another perspective view showing details of the system.
Figure 5:
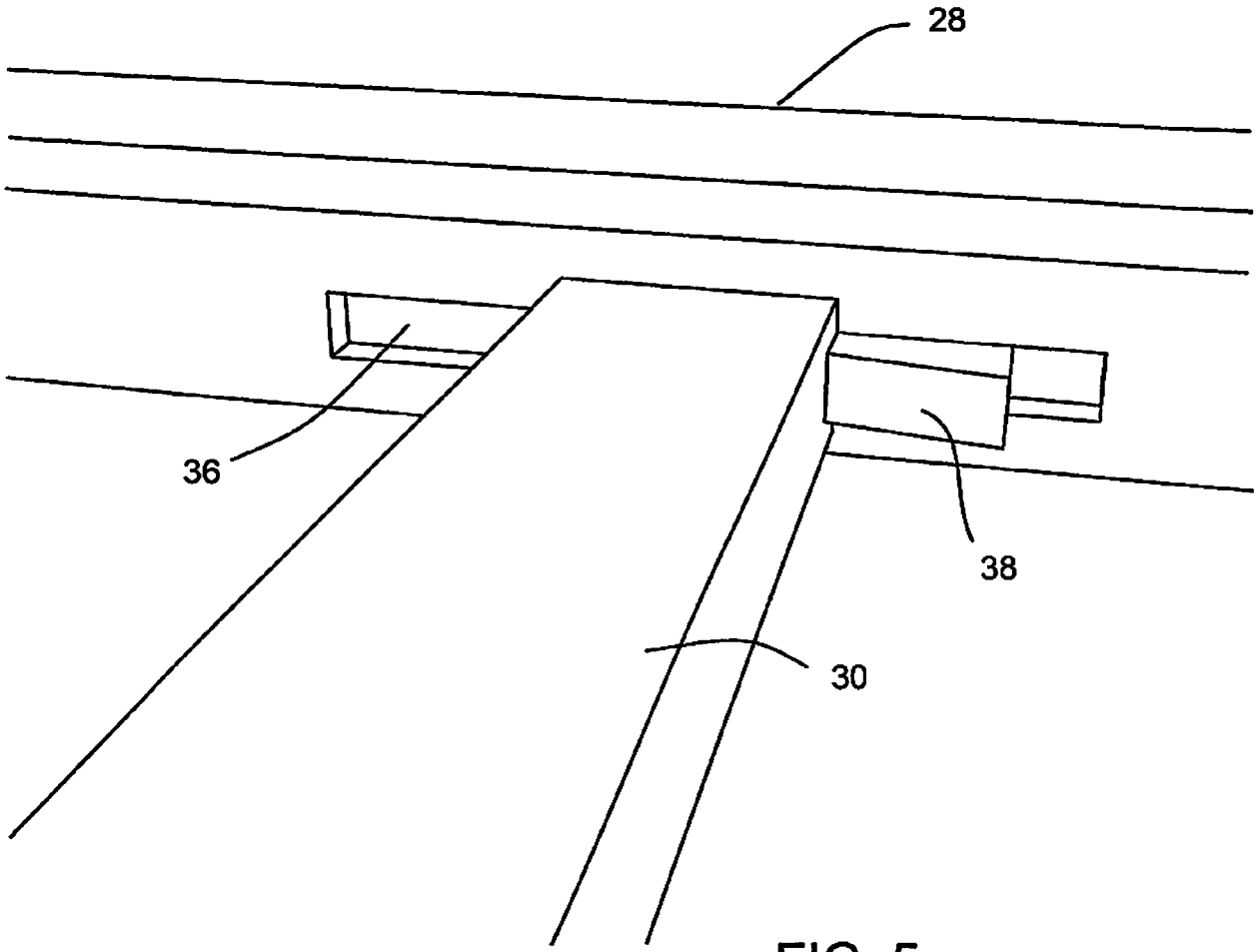
FIG. 5 is an enlarged view showing a brace and stretcher bar and the keying system of the invention.
Figure 6:
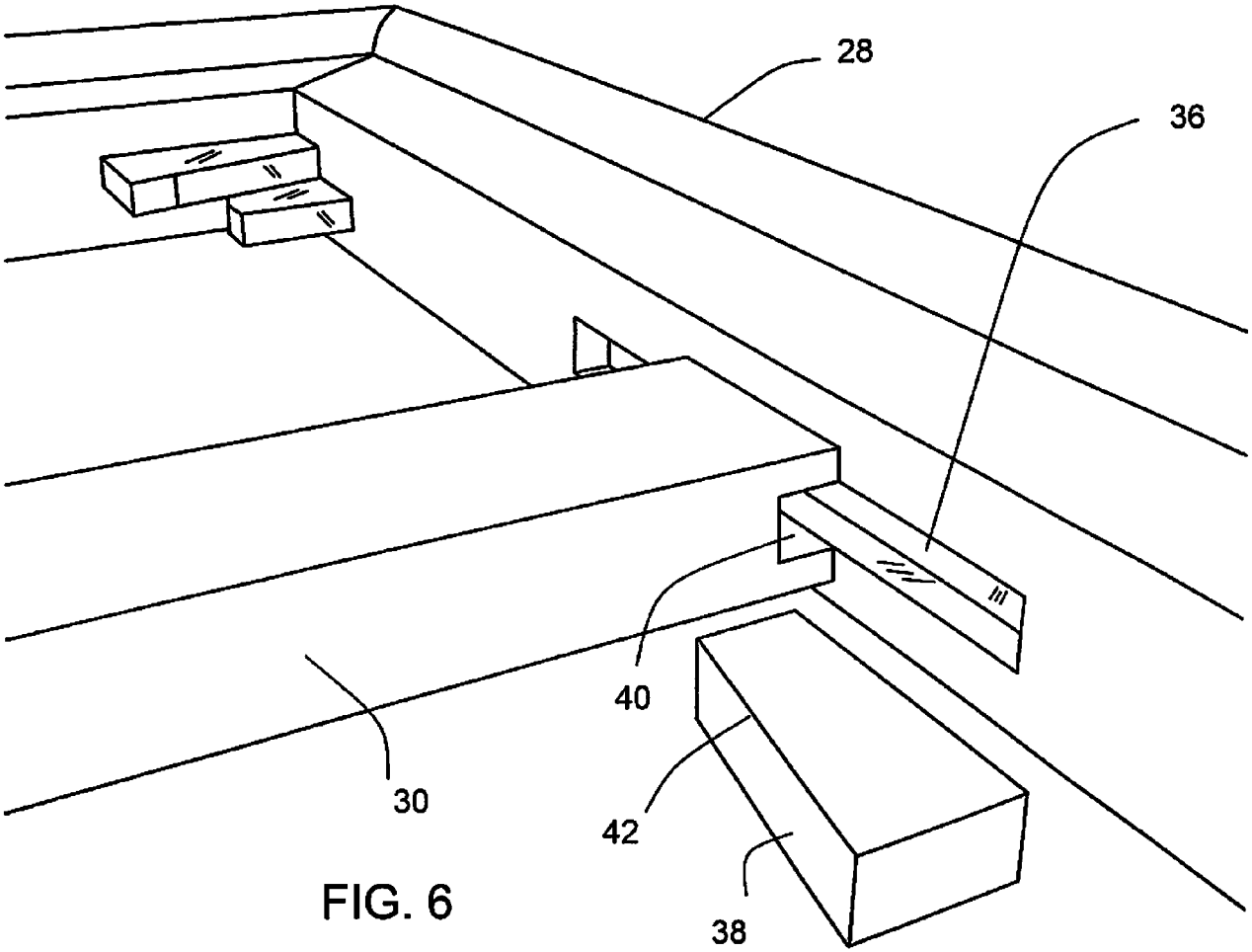
FIG. 6 is another perspective view showing the stretcher bar, brace and key.
Figure 7:
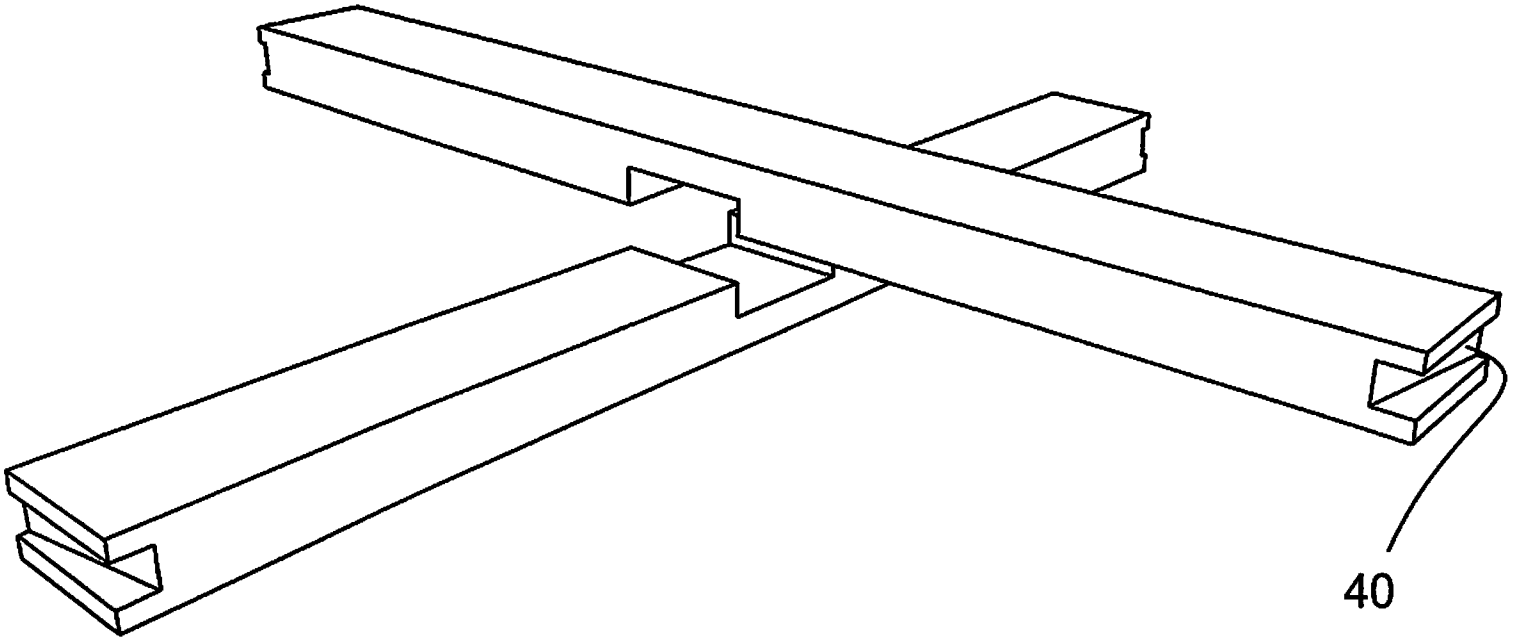
FIG. 7 is a further perspective view showing components of the invention.

FIGS. 5 and 6 show a key 38 in place in a recess or groove 36 of a stretcher bar 28 (FIG. 5) and removed from the brace and stretcher bar (FIG. 6). FIGS. 5 and 6 show that the groove or recess 36 in the side of the stretcher bar is elongated, and is of uniform depth and width throughout its length, in the preferred embodiment. The end of the brace 30 has a mating groove 40, of essentially the same width (top to bottom as seen in these drawings) as that of the stretcher bar groove 36. This width, which may be about ⅜ inch (for a stretcher bar 28 of about 1 inch at its inner side), is substantially the same as the width of the key 38, so that the key preferably will fit snugly in place in the aligned grooves 36 and 40 of the brace and the stretcher bar. Note that the length of the stretcher bar groove 36 preferably is sufficient that the key can be inserted from either side, which will depend on the orientation of the brace. Once wedged in place, the key 38 can be secured there, if desired, by a screw or piece of wood or other material inserted into the groove 36 behind the key. This prevents the key from backing out. The brace's groove 40, as seen in FIG. 7, is sloped to form a ramp that preferably (but not necessarily) essentially matches the slope of the key edge 42 seen in FIG. 6. The length of the bar groove 36 is important because the braces can be used in either the orientation shown or flipped over, which will orient the larger side of the brace groove 40 toward the opposite direction. As seen in FIG. 4, the last of the braces to be put in place is somewhat restrained in position by the notched-together connection at 34, so that only limited side-to-side manipulation along the stretcher bar groove 36 is available, and the groove 36 must be capable of accommodating a key inserted from either side. Some manipulation of the brace left or right along the groove is possible, allowing the bar groove 36 to be shortened somewhat.

Figure 1:
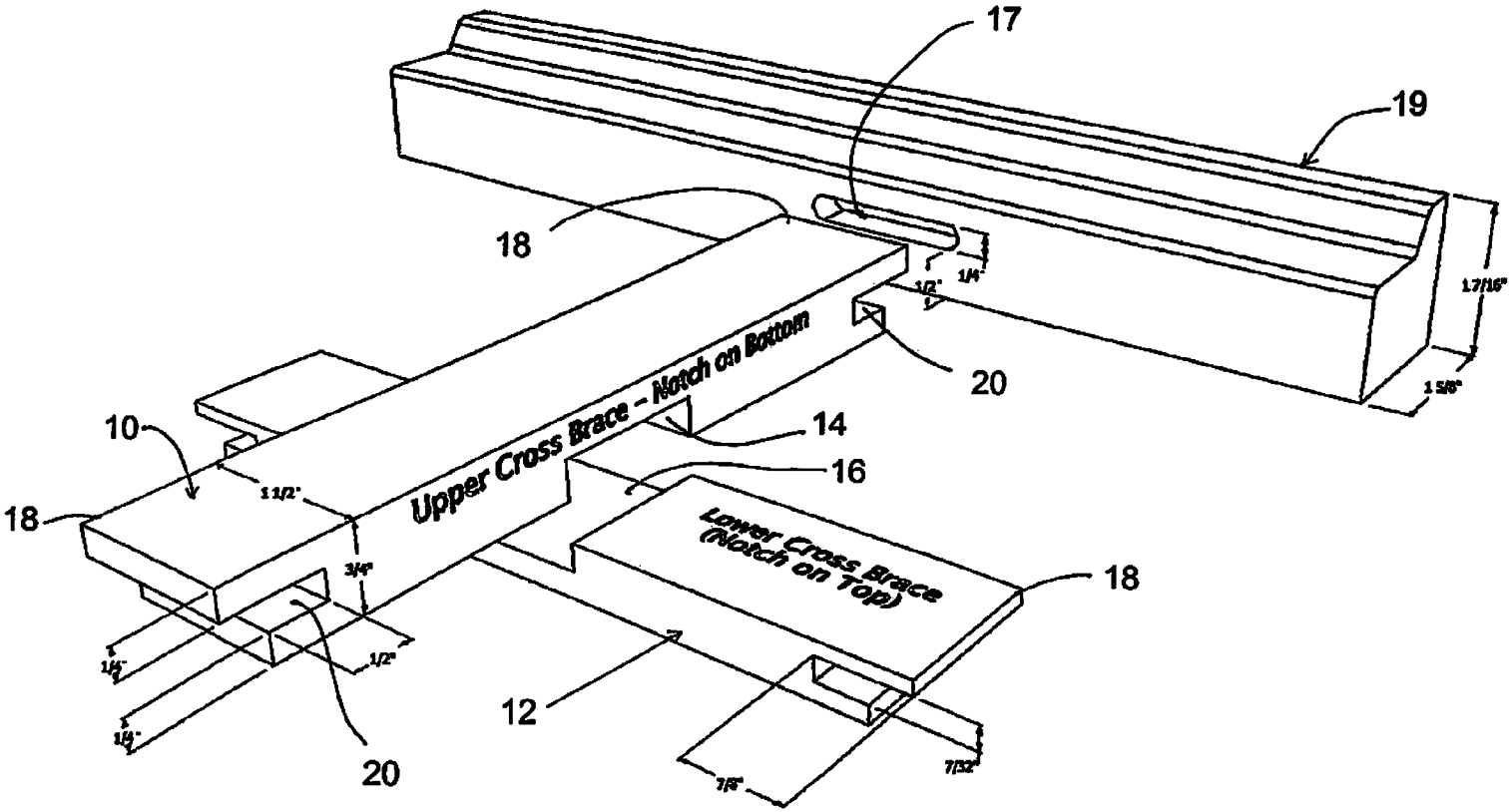
FIG. 1 PRIOR ART
FIGS. 1 and 2 are perspective views showing a typical prior art bracing system for canvas stretcher frames.
Figure 2:
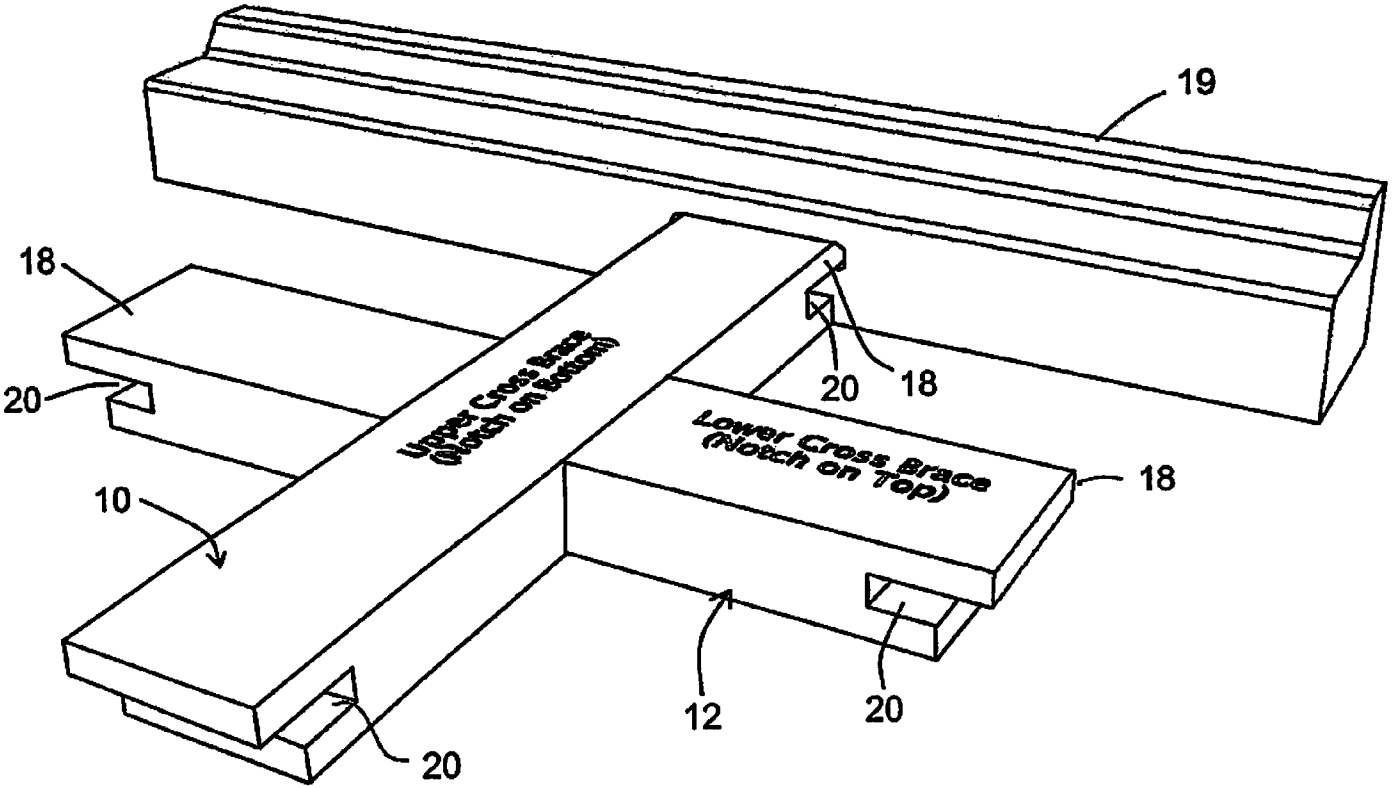
FIG. 2 PRIOR ART

Another benefit of the invention is in the ability to build a stretched canvas frame efficiently with braces. Because the braces themselves need not protrude into the stretcher bars, one can install the brace after the frame is built and the canvas is stretched. Also, if the brace breaks for any reason, due to mishandling, shipping or other causes, a new brace and cross brace can be easily installed without having to take the canvas off the frame. This is not easily possible with conventional style braces and frames as shown in FIGS. 1 and 2.

Figure 8:
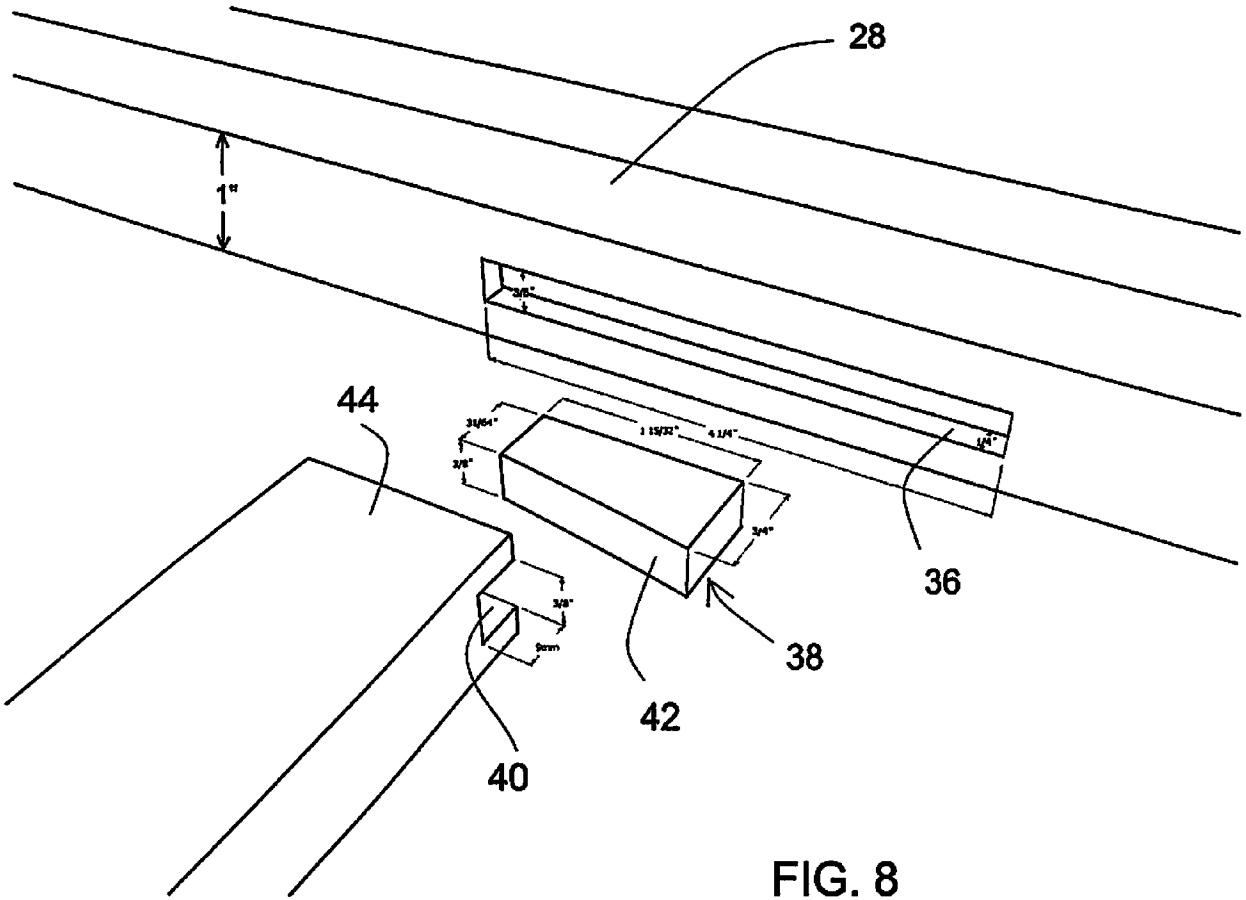
FIG. 8 is a detail view showing a key and its relation to a brace and a stretcher bar.

FIG. 8 shows exemplary dimensions for one preferred embodiment, which can be applicable to a 1½ inch depth stretcher frame, with bar thickness at inner side about 1 inch, as shown. The brace can have a thickness of about ¾ inch. As an example, the stretcher bar groove 36 can have a depth of about ¼ inch and a width of about ⅜ inch. The key, as noted above, can have a similar width of ⅜ inch, and can have a length of about 1½ inches or slightly less, a height at the taller side of about ¾ inches, and a height at the shorter side of about 15/32 inch or more preferably be about 31/64 inch. These dimensions provide a slope of about 18% (angle of about 10°); different angles can be used. The brace has a groove 40 of about ⅜ inch, similar to the width of the key, and the depth of the brace groove can be about ⅜ inch and tapering down to a shallower depth less than ¼ inch at the other end, so as to match or essentially to match the slope 42 of the key 38. Note that the width of the brace, along the edge seen at 44, should be related to the length of the bar slot 36 and the length of the key 38. Since the key should be available to insert from either side of a brace when it abuts against the stretcher bar, the width of the brace end at the edge 44 should be little or no more than the length of the slot 36 less two times the length of the key. Thus, if the bar slot is at least 4¼ inches and the key is 1½ inches in length, this leaves 1¼ inches for the brace, which will be located essentially at the center of the slot 36. The brace can actually be somewhat wider, e.g. about 1½ to 1¼ inch, because it can be manipulated to some extent when inserting the key, and this is true even for the last brace to be installed in a set of crossed braces. In practice, a preferred bar slot length is about 4¾ to 5 inches for a brace of 1½ inch width, providing plenty of space to work with.

For a frame with stretcher bars of only about inch inner side width, i.e. thickness (which could be a nominal ¾ inch frame), the stretcher bar groove, and likewise the keys or wedges, can have a width (thickness) of about 3/16 inch. The braces themselves can have a thickness of about ½ inch; the brace thickness preferably is essentially no greater than the inner side thickness of the stretcher bar, and it can be the same as the stretcher bar.

All of the above dimensions are examples of preferred embodiments, and can vary. For frames of larger cross section, braces, keys and grooves of larger dimensions can be used.

It should be understood that the invention encompasses the connection of a brace end to a stretcher bar and the wedged-shaped key mechanism that both makes the connection and provides for adjusting the spread between stretcher bars at opposed sides of a canvas stretching frame. In some applications only a single end of a brace may have this connection mechanism, the opposite end of the brace simply having a tenon which fits into the groove formed in the stretcher bar. This is particularly true in the case where only a single brace is used in the canvas frame, but it also could be true of both braces in a system of crossing braces; proper adjustment of the braces as the last is installed will be accomplished by sliding movement in the groove.

Also, while the brace end has a taper in its groove, and this is preferred, the taper is not essential. One could have square cut ends and apply a tapered key, and still accomplish the same goal, although this would not work as well as the tapered end and the key would not be retained as firmly. Note that if the brace groove 40 is non-tapered, i.e. has a groove bottom that is not sloped, then the stretcher bar groove 36 could be much shorter since only one side would need be available for key insertion.

A benefit of the invention is that it provides the ability to remove the entire bracing structure by simply removing the keys. For example, if the brace were damaged in some way and needed replacement, another single brace or pair of crossing braces can be reinserted into the frame without needing to dismantle the frame, which is in contrast with the typical prior art system as shown in FIGS. 1 and 2.

The primary and basic benefits of this invention are that it enables the canvas frame to be tensioned from the corners and from the middle of the frame, which is where most of the tension is required; and it also makes possible the expansion of a frame from the middle in canvas frames that are otherwise too thin (e.g. inner side stretcher bar thickness no more than inch) to practically produce an expandable frame, since the wood components would be too small and susceptible to breakage with the traditional system being used. The system of the invention works well because it allows the key to be substantially larger than in other methods. Size is important as the key must endure all of the stress and load of the expansion process and mechanism.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A bracing system for a stretched canvas that includes four stretcher bars forming a stretching frame and a canvas attached to the stretching frame, comprising:

at least some of the stretcher bars having a substantially planar inside surface with a stretcher bar groove of a first length, the stretcher bar groove extending in a long direction of the stretcher bar, a cross brace extending from the inside surface of one stretcher bar across to the inside surface of an opposite stretcher bar, the brace having a width which is less than said first length, the brace having two ends, each end having a brace groove, the brace groove being oriented parallel to the stretcher bar groove and being adjacent to the stretcher bar groove, a tapered key shaped as a wedge, the key having two opposed planar and non-parallel sides and a thickness such as to fit in the stretcher bar groove and the brace groove, the key's non-parallel sides defining a slope, the key being wedged into the two adjacent grooves so as to be urging the stretcher bar away from the brace, and the brace at said one end being without any tenon or any structure of the brace extending into a stretcher bar groove, the stretcher bar groove and the brace groove being juxtaposed without any interconnection between the stretcher bar and the brace other than the key, the brace end being retained in place at the stretcher bar solely by the key, wedged into the two adjacent grooves.

2. The bracing system of claim 1, wherein both ends of the brace include said brace groove and are retained in place against an adjacent stretcher bar by a said key.

3. The bracing system of claim 1, including two crossing braces secured to the stretching frame, each of the braces having said brace groove and having one end secured to an adjacent stretcher bar by a said key.

4. The bracing system of claim 1, wherein the brace groove has a planar sloped bottom so that the brace groove has a varying depth through the width of the brace, and with the key's slope generally matching the sloped bottom of the brace groove.

5. The bracing system of claim 1, wherein the stretching frame is a nominal ¾ inch frame, and wherein the stretcher bars of the frame have an inner side thickness of about ½ inch.

6. The bracing system of claim 1, wherein the stretcher bars of the stretching frame have an inner side thickness of no more than about ½ inch.

7. The bracing system of claim 6, wherein the thickness of the brace end is about ½ inch.

8. The bracing system of claim 1, wherein the thickness of the brace end is essentially no more than an adjacent thickness of the stretcher bar inside surface.

9. The bracing system of claim 1, wherein the width of the brace at said one end, in the direction parallel to the stretcher bar's length, is about equal to the length of the stretcher bar groove less two times the length of the key, so that the key can be inserted into the stretcher bar groove and the brace groove from either side of the brace.

* * * * *